US009909764B2

(12) United States Patent
Bach

(10) Patent No.: US 9,909,764 B2
(45) Date of Patent: Mar. 6, 2018

(54) COOKING APPLIANCE AND METHOD FOR LIMITING COOKING UTENSIL TEMPERATURES USING DUAL CONTROL MODES

(71) Applicant: Haier US Appliance Solutions, Inc., Wilmington, DE (US)

(72) Inventor: James Carter Bach, Seymour, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/206,366

(22) Filed: Jul. 11, 2016

(65) Prior Publication Data

US 2018/0010804 A1 Jan. 11, 2018

(51) Int. Cl.
*H05B 1/02* (2006.01)
*F24C 7/08* (2006.01)

(52) U.S. Cl.
CPC ..... *F24C 7/088* (2013.01); *H05B 1/0266* (2013.01)

(58) Field of Classification Search
CPC ..... F24C 7/088; H05B 1/0266; H05B 1/0261; H05B 3/0076; H05B 2213/04; H05B 2213/07
USPC ..... 219/4.1, 448.15, 448.16, 448.17, 446.1, 219/497
See application file for complete search history.

(56) References Cited

U.S. PATENT DOCUMENTS 4,214,151 A * 7/1980 Kicherer ..... F24C 15/106 219/457.1
4,347,432 A * 8/1982 Gossler ..... H05B 1/0216 219/448.19
4,755,655 A * 7/1988 Reiche ..... H05B 3/72 219/448.11
5,352,864 A * 10/1994 Schultheis ..... H05B 3/746 219/448.17
6,285,012 B1 9/2001 Connolly et al.
RE42,513 E * 7/2011 Clothier ..... H05B 6/062 219/494
9,131,537 B2 9/2015 Broders et al.
9,132,302 B2 9/2015 Luongo et al.
2016/0014849 A1* 1/2016 Hegedis ..... H05B 6/1263 219/627
2016/0076775 A1 3/2016 Luongo et al.
2016/0316519 A1* 10/2016 Gomez ..... H05B 3/746

* cited by examiner

*Primary Examiner* — Mark Paschall
(74) *Attorney, Agent, or Firm* — Dority & Manning, P.A.

(57) ABSTRACT

Cooking appliances and methods for operating cooking appliances are provided. In one exemplary embodiment, a method for operating a cooking appliance is provided. The method includes providing power to the heating source according to a first control mode; determining whether to transition from the first control mode to a second control mode and, if so, then providing power to the heating source according to the second control mode. The method further includes determining whether to transition to the first control mode and, if so, then returning to providing power to the heating source according to the first control mode. The cooking appliances and methods include features for limiting cooking utensil temperatures using dual control modes.

12 Claims, 9 Drawing Sheets

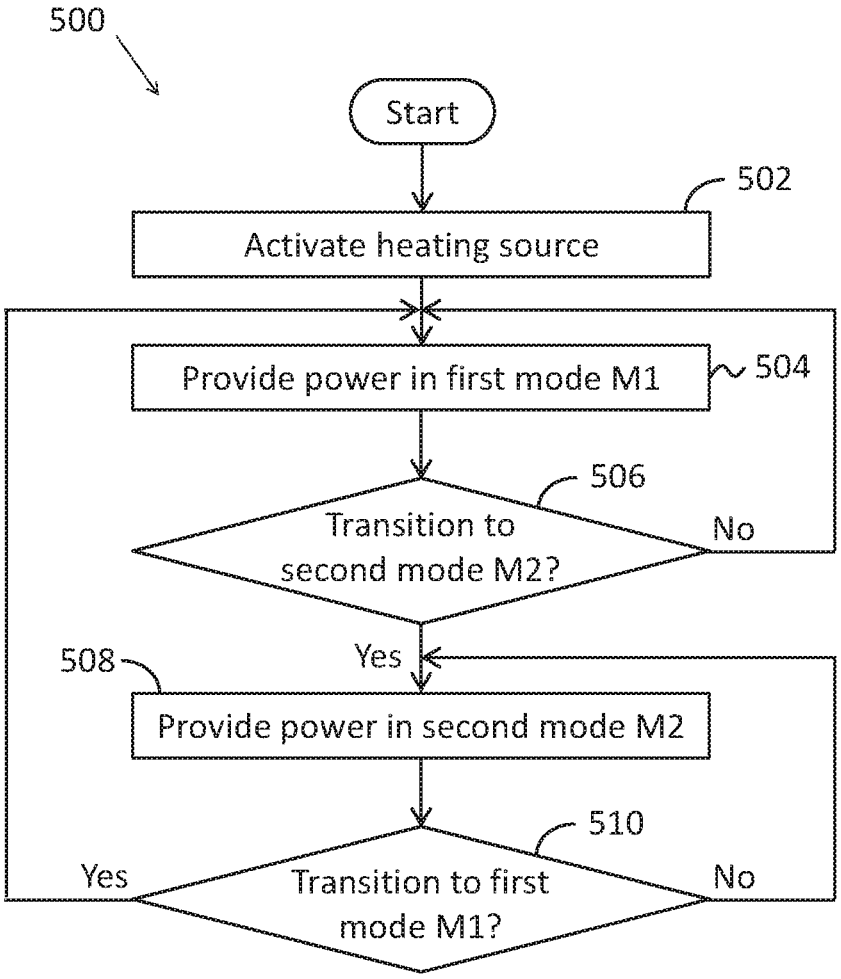
FIG. – 5 –

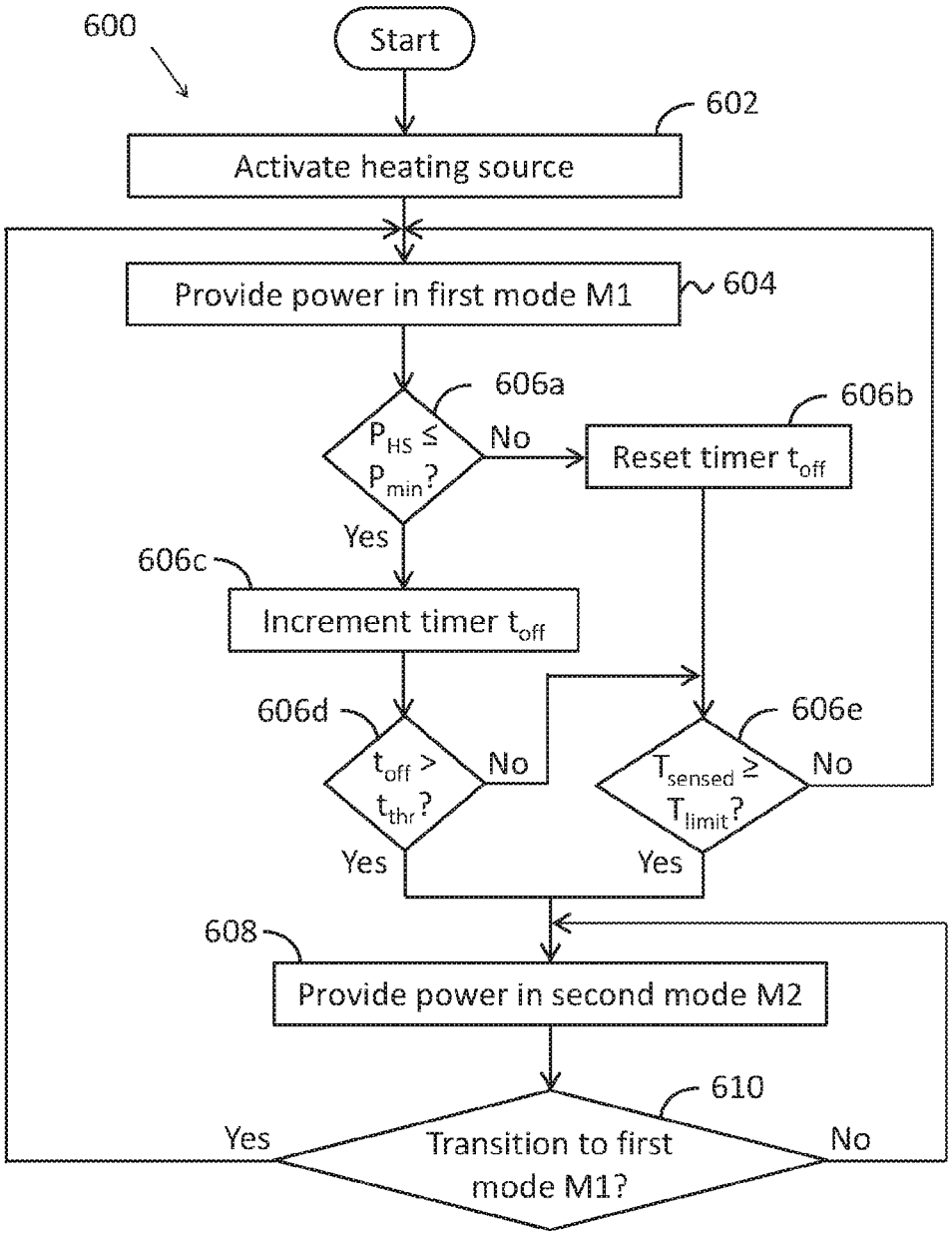
FIG. – 6 –

COOKING APPLIANCE AND METHOD FOR LIMITING COOKING UTENSIL TEMPERATURES USING DUAL CONTROL MODES

FIELD OF THE INVENTION

The present subject matter relates generally to a cooking appliance and methods for operating a cooking appliance. More particularly, the present subject matter relates to cooking appliances and methods for operating cooking appliances to limit the temperature of a cooking utensil positioned on a heating source of the cooking appliance.

BACKGROUND OF THE INVENTION

Cooking appliances, such as, e.g., cooktops (also known as hobs) or ranges (also known as stoves), generally include one or more heated portions for heating or cooking food items within a cooking utensil placed on the heated portion. The heated portions utilize one or more heating sources to output heat, which is transferred to the cooking utensil and thereby to any food item or items within the cooking utensil. Typically, an electronic controller or other control mechanism, such as a thermo-mechanical electrical switch (also known as an infinite switch), regulates the heat output of the heating source selected by a user of the cooking appliance, e.g., by turning a knob or interacting with a touch-sensitive control panel. For example, the control mechanism may cycle the heating source between an activated or on state and a substantially deactivated or off state such that the average heat output approximates the user-selected heat output. This cycling action may have a period of several seconds, as is typically the case when relays are employed, or might take place on each half-cycle of an AC waveform, which is possible with semiconductor switching devices.

However, the transfer of heat to the cooking utensil and/or food items may cause the food items or cooking utensil to overheat or otherwise cause unwanted and/or unsafe conditions on the cooktop. Although the cooking appliance usually has features for regulating the heat output of the heating source as described above, setting the heat output to a high level can cause the cooking utensil, and its contents, to reach excessively high temperatures. As an example, a high heat output setting may cause a frying pan or skillet containing only a thin layer of cooking oil to quickly rise in temperature because the thermal mass of the cooking utensil and cooking oil is small. In some cases, the temperature may rise such that the cooking oil self-ignites. On the other hand, a high heat output setting typically does not lead to dangerous conditions for large food loads, e.g., a pot filled with water, because the large thermal mass slows the rate at which the cooking utensil and food heat up and, in this particular example, because water is a self-temperature-regulating compound and is not a self-igniting chemical compound. Therefore, cooking performance of the cooking appliance may be negatively impacted if the appliance regulates every use of a high heat output setting regardless of the temperature reached by the cooking utensil and/or its contents.

Accordingly, a cooking appliance with features for selectively limiting a maximum temperature reached by a cooking utensil placed on a heating source of the cooking appliance without impacting the performance of the cooking appliance during other cooking operations would be useful. Methods for operating a cooking appliance to selectively limit a maximum temperature reached by a cooking utensil placed on a heating source of the cooking appliance without impacting the performance of the cooking appliance during other cooking operations also would be beneficial. In particular, an appliance and its associated methods that limits a maximum temperature reached by a lightly-loaded cooking utensil containing highly combustible foods (e.g., cooking oil, grease, and bacon) but does not limit the heat output to a heavily-loaded cooking utensil containing non-combustible foods (e.g., water or a water-based sauce) would be advantageous.

BRIEF DESCRIPTION OF THE INVENTION

Aspects and advantages of the invention will be set forth in part in the following description, or may be obvious from the description, or may be learned through practice of the invention.

In one exemplary embodiment of the present subject matter, a method for operating a cooking appliance is provided. The method includes providing power to the heating source according to a first control mode; determining whether to transition from the first control mode to a second control mode and, if so, then providing power to the heating source according to the second control mode. The method further includes determining whether to transition to the first control mode and, if so, then returning to providing power to the heating source according to the first control mode.

In another exemplary embodiment of the present subject matter, a method for operating a cooking appliance is provided. The method includes providing power to the heating source according to a first control mode; determining whether the power provided is less than a minimum power level and, if so, then incrementing a timer. The method also includes determining whether the timer has surpassed a threshold time interval and, if so, then providing power to the heating source according to a second control mode. The method further includes determining whether the temperature of the cooking utensil is at or below a threshold temperature and, if so, then returning to providing power to the heating source according to the first control mode.

In a further exemplary embodiment of the present subject matter, a cooking appliance is provided. The cooking appliance includes a heating source; a temperature sensor; an energy control device for modulating the power provided to the heating source; and a controller. The temperature sensor is positioned to sense the temperature of a bottom surface of a cooking utensil when the cooking utensil is placed on or adjacent to the heating source. The controller is in operative communication with the temperature sensor and the energy control device. The controller is configured for providing power to the heating source according to a first control mode, determining whether to transition from the first control mode to a second control mode and, if so, then providing power to the heating source according to the second control mode. The controller is further configured for determining whether to transition to the first control algorithm and, if so, then returning to providing power to the heating source according to the first control mode.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 5 provides a chart illustrating a method of operating a cooking appliance according to an exemplary embodiment of the present subject matter.

FIG. 6 provides a chart illustrating another exemplary method of operating a cooking appliance.

DETAILED DESCRIPTION OF THE INVENTION

Figure 1:
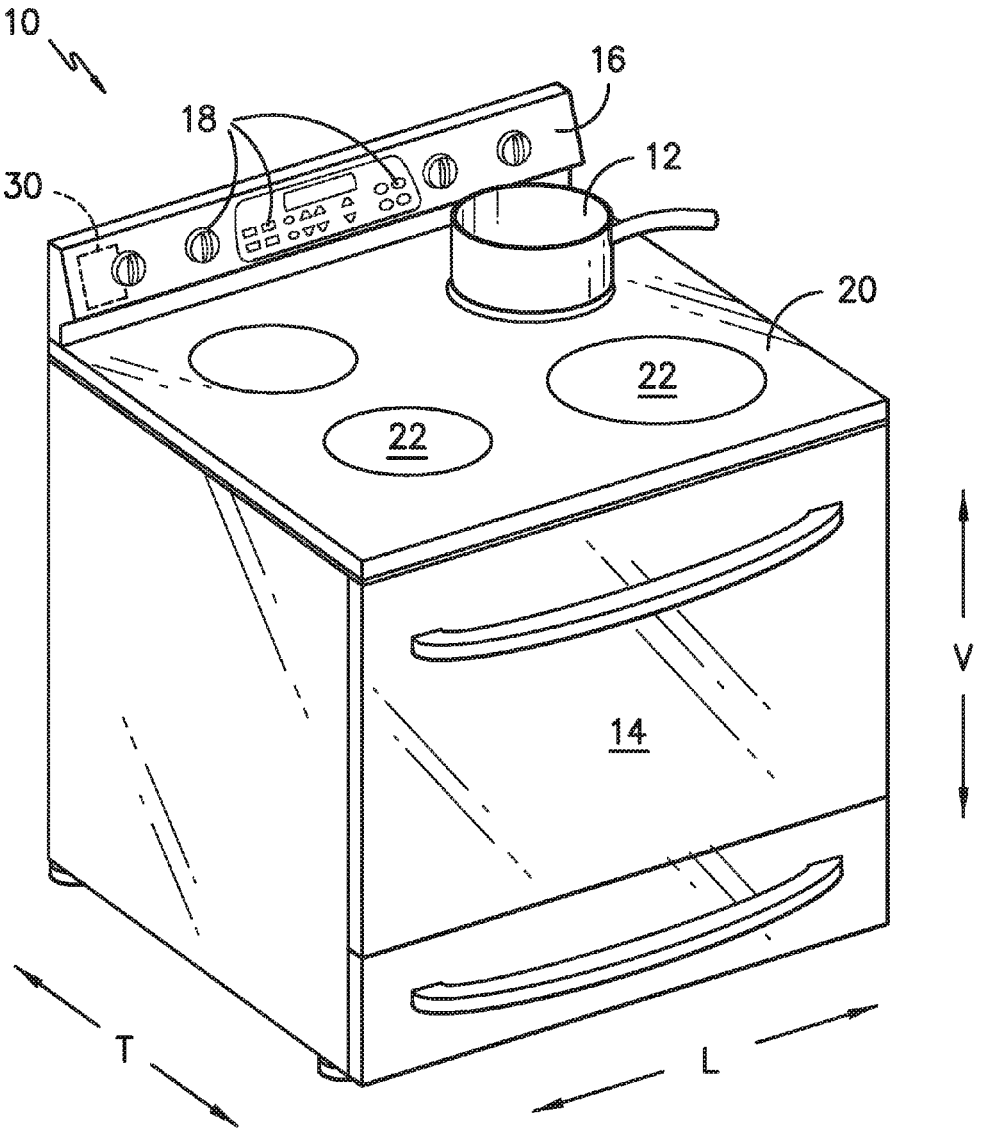
FIG. 1 provides a side, perspective view of a cooking appliance according to an exemplary embodiment of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Further, each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, wherein identical numerals indicate the same elements throughout the figures, FIG. 1 is a side, perspective view of a cooking appliance, generally referred to as a stove or range, according to an exemplary embodiment of the present subject matter. Cooking appliance 10 may be a range appliance as shown in FIG. 1, which has an oven positioned vertically below a cooktop. However, cooking appliance 10 is provided by way of example only and is not intended to limit the present subject matter in any aspect. Thus, the present subject matter may be used with other cooking appliance configurations, e.g., cooktop appliances without an oven. Further, the present subject matter may be used in any other suitable appliance.

Figure 2:
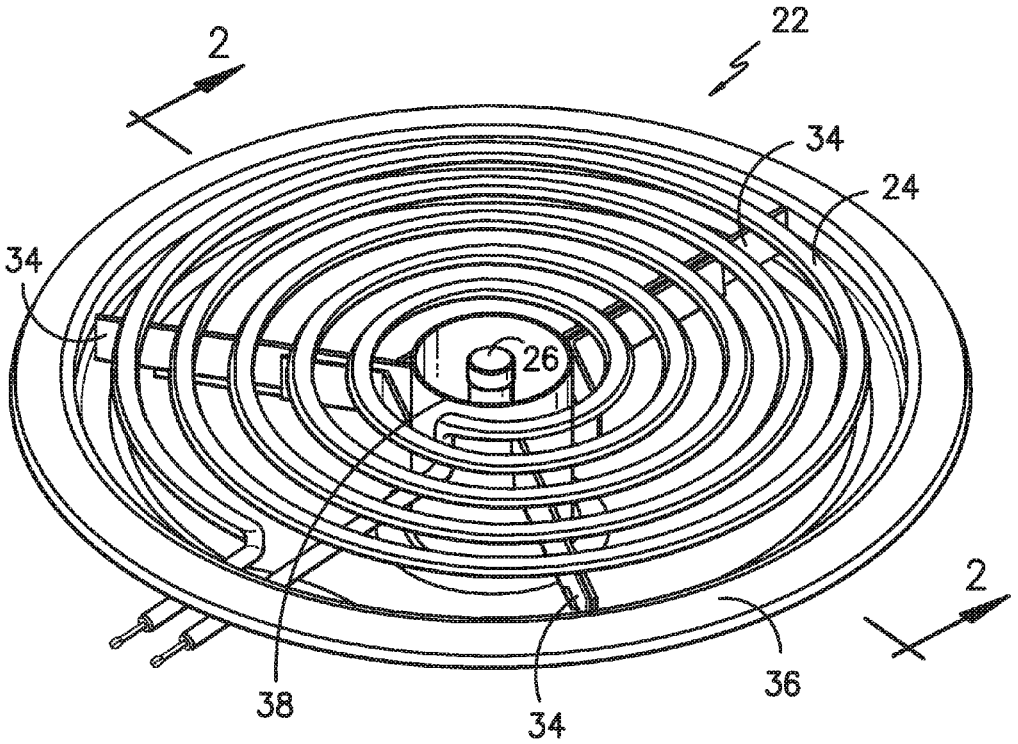
FIG. 2 provides a top, perspective view of a heating source assembly of the cooking appliance of FIG. 1 according to an exemplary embodiment of the present subject matter.
Figure 3:
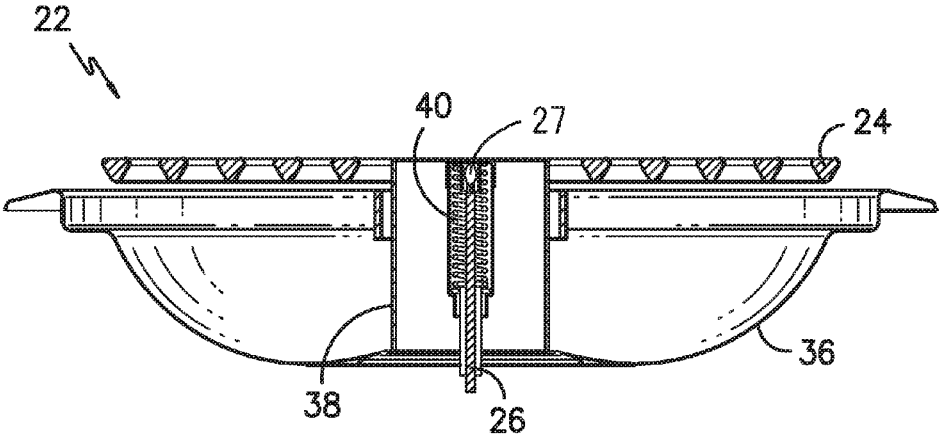
FIG. 3 provides a cross-section view of the heating source assembly of FIG. 2.

Cooking surface 20 of cooking appliance 10 includes heating source assemblies 22 having heating sources 24 (FIG. 2). Heating sources 24 may be, e.g., electrical resistive heating elements, gas burners, induction coils, and/or any other suitable heating source. In some embodiments, cooking appliance 10 may be a radiant or induction cooktop appliance, and cooking surface 20 may be an essentially solid surface constructed of a glass, ceramic, or a combination glass-ceramic material, or any other suitable material. In the exemplary embodiment as shown in FIGS. 2 and 3, the cooking appliance 10 may be an electric coil cooktop appliance, and cooking surface 20 may be constructed of a metallic material, e.g., steel or stainless steel, and the heating source assemblies 22 may utilize exposed, electrically-heated, helically-wound planar coils as heat sources 24. Each heating source assembly 22 of cooking appliance 10 may be heated by the same type of heating source 24, or cooking appliance 10 may include a combination of different types of heating sources 24. Further, heating source assemblies 22 may have any suitable shape and size, and cooking appliance 10 may include a combination of heating source assemblies 22 of different shapes and sizes.

As shown in FIG. 1, a cooking utensil 12, such as a pot, kettle, pan, skillet, or the like, may be placed on or adjacent a heating source assembly 22 to cook or heat food items placed within the cooking utensil. For example, utensil 12 may be positioned directly on heating source 24 of a cooking appliance having electrical resistive heating elements, such as electric resistance coils. As another example, utensil 12 may be placed on a grate vertically above heating source 24 when the heating source is a gas burner. As a further example, utensil 12 may be placed on a support surface, such as a glass-ceramic cooktop, for embodiments in which heating source 24 is an induction or electric radiant heating source located below the support surface. In each embodiment, utensil 12 may be positioned directly on or adjacent heating source 24 such that heating source 24 can provide heat to utensil 12 to cook or heat any food items within the utensil.

Referring still to FIG. 1, cooking appliance 10 also includes a door 14 that permits access to a cooking chamber (not shown) of appliance 10, the cooking chamber for cooking or baking of food or other items placed therein. A control panel 16 having user controls 18 permits a user to make selections for cooking of food items using heating source assemblies 22 and/or the cooking chamber. Although shown on a backsplash or back panel of cooking appliance 10, control panel 16 may be positioned in any suitable location, e.g., along a front edge of the appliance or on the cooking surface 20. Controls 18 may include buttons, knobs, and the like, as well as combinations thereof. As an example, a user may manipulate one or more user controls 18 to select, e.g., a power or heat output level for each heating source assembly 22. The selected heat output level of heating source assembly 22 affects the heat transferred to cooking utensil 12 placed on heating source assembly 22, as further described below.

The operation of cooking appliance 10, including heating sources 24, may be controlled by a processing device such as a controller 30, which may include a microprocessor or other device that is in operative communication with components of appliance 10. Controller 30 may include a memory and microprocessor, such as a general or special purpose microprocessor operable to execute programming instructions or micro-control code associated with a cleaning cycle. The memory may represent random access memory such as DRAM, and/or read only memory such as ROM or FLASH. In one embodiment, the processor executes programming instructions stored in memory. The memory may be a separate component from the processor or may be included onboard within the processor. Alternatively, controller 30 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Controls 18 and other components of cooking appliance 10 may be in communication with controller 30 via one or more signal lines or shared communication busses.

In some embodiments, one or more components of cooking appliance 10 may be controlled independent of controller 30. For example, the heat output of heating source 24 may be controlled by a mechanical, electromechanical, or thermo-electro-mechanical control mechanism, such as, e.g., an infinite switch. In other embodiments, a combination of controller 30 and one or more other control mechanisms may be used to control the features of cooking appliance 10. As an example, controller 30 may control the heat output of heating source 24 during one or more operating modes of appliance 10 and another control mechanism, such as the infinite switch, may control the heat output during other operating modes of appliance 10.

FIG. 2 provides a top, perspective view of a heating source assembly 22 according to an exemplary embodiment of the present subject matter. In the illustrated exemplary embodiment, heating source 24 is a spiral shaped electrical resistive heating element; that is, FIG. 2 illustrates a heating source assembly 22 for an electric coil cooking appliance. Cooking utensils 12 are placed directly on heating source 24 of the illustrated cooking appliance 10. As shown, heating source 24 may be supported by one or more support elements 34, which also help support cooking utensil 12 when placed on heating source 24. Moreover, in the depicted embodiment, a temperature sensor 26 is positioned approximately in the center of heating source assembly 22. Temperature sensor 26 may be used, e.g., to measure the temperature of a cooking utensil 12 placed on the respective heating source assembly 22 and provide such temperature measurements to controller 30. As such, temperature sensor 26 may be a resistive temperature device (RTD), a thermistor, a thermocouple (TC), or any other appropriate temperature sensing device.

In the depicted embodiment, temperature sensor 26 is positioned such that sensor 26 contacts a bottom surface 11 of cooking utensil 12 (FIG. 1) when cooking utensil 12 is placed on heating source 24 of assembly 22. More particularly, a sensing element 27 (FIG. 3) of temperature sensor 26 contacts a bottom surface 11 of cooking utensil 12 in configurations of cooking appliance 10 using, e.g., electric resistance heating elements or gas burners as heating sources 24. Sensing element 27 may directly contact bottom surface 11 or may indirectly contact bottom surface 11, e.g., a top portion of sensor 26 may directly contact bottom surface 11 and sensing element 27 may directly contact the top portion of sensor 26. In other embodiments of appliance 10, such as cooking appliances utilizing electric radiant heating elements or induction heating elements as heating sources 24, sensing element 27 may be positioned to contact an underside of a support surface of appliance 10 adjacent the bottom surface 11 of a cooking utensil 12 placed on the support surface. Sensing element 27 may directly contact the underside of the support surface or may indirectly contact the underside of the support surface, e.g., a top portion of sensor 26 may directly contact the underside and sensing element 27 may directly contact the top portion of sensor 26. Positioning temperature sensor 26 approximately in the center of heating source assembly 22 may help ensure that temperature sensor 26 contacts a cooking utensil 12 placed on heating source 24 no matter the size or shape of utensil 12. However, sensor 26 may be positioned in any suitable location within the heating source assembly 22.

FIG. 3 provides a cross-section view of heating source assembly 22 shown in FIG. 2. As illustrated, heating source assembly 22 may have a generally semi-circular cross-section, but in other embodiments, heating source assembly 22 may have other cross-sectional shapes. In the depicted embodiment, heating source assembly 22 includes a drip pan 36 positioned below heating source 24 along the vertical direction V. Drip pan 36 may help collect any spills, boil-overs, or other debris from cooking activities or other uses of cooking appliance 10. Further, as most clearly shown in FIG. 2, a heat shield 38 extends circumferentially about temperature sensor 26. Heat shield 38 may be provided to minimize convective airflow and/or deflect or reflect radiation of heat from heating source 24 to sensor 26, which could negatively impact the temperature readings or measurements of sensor 26, e.g., by artificially elevating the temperature sensed by temperature sensor 26. As shown, heat shield 38 may be generally cylindrical in shape, but other shapes may be used as well. In some embodiments, heat shield 38 may be omitted. Further, although FIG. 3 depicts heat shield 38 being connected to, or a part of, drip pan 36, other configurations may be used as well. For example, heat shield 38 could extend through an opening in a bottom surface of drip pan 36 and be attached to another portion of the appliance, such as a chassis of the appliance, or heat shield 38 could be attached directly to the support elements 34 beneath the heating source 24.

Preferably, temperature sensor 26 is a spring-loaded sensor as depicted in FIG. 3. Spring-loaded temperature sensor 26 includes a spring 40 that helps position sensing element 27 in contact with or immediately adjacent bottom surface 11 of cooking utensil 12 positioned on or adjacent heating source 24. Further, spring 40 assists in keeping temperature sensing element 27 in contact with bottom surface 11, or the surface supporting utensil 12, while utensil 12 remains on heating source 24. Keeping sensing element 27 in contact with bottom surface 11 or the support surface facilitates more accurate measurements of the temperature of cooking utensil 12. Improving accuracy in measuring the temperature of cooking utensil 12 helps controller 30 better control the power provided to heating source 24, e.g., to ensure cooking utensil 12, and/or food items within utensil 12 do not exceed a maximum temperature. Of course, temperature sensor 26 may have other configurations appropriate for measuring the temperature of cooking utensil 12 positioned on heating source 24 and/or the temperature of food items placed within cooking utensil 12.

Figure 4A:
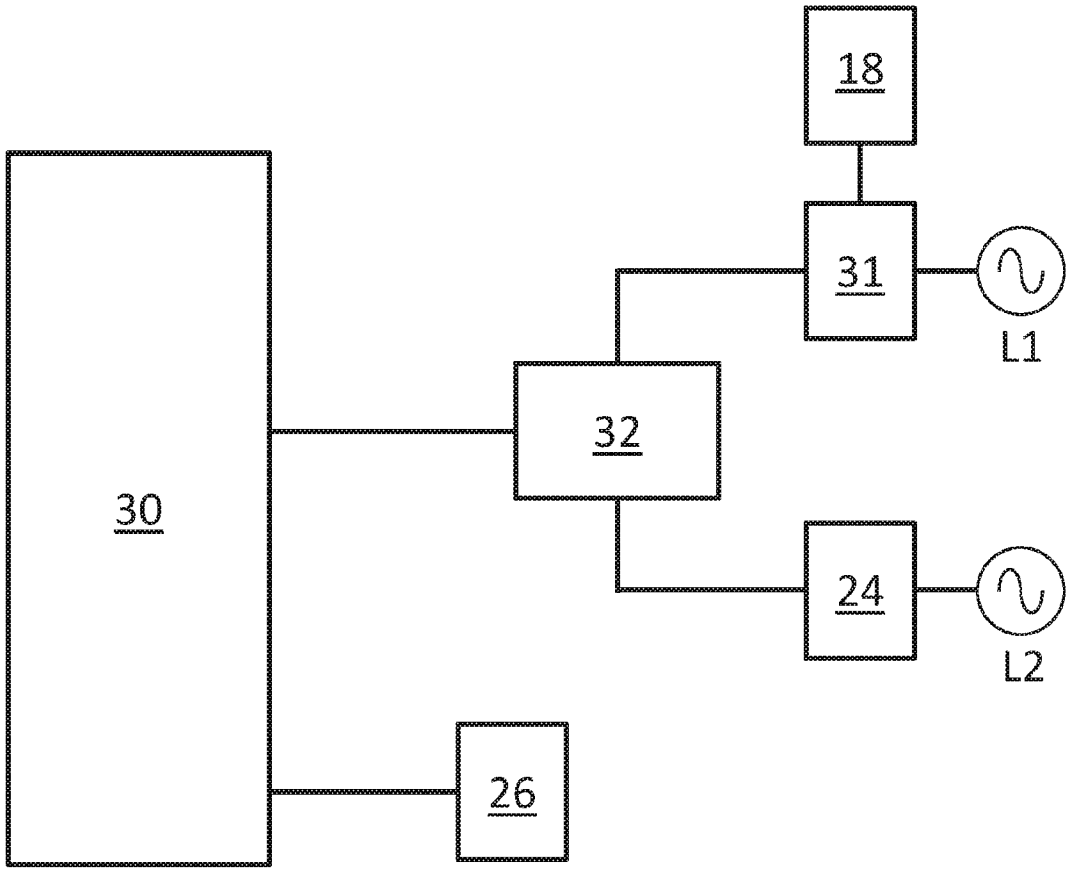
FIG. 4A provides a schematic diagram of a portion of the cooking appliance of FIG. 1.
Figure 4B:
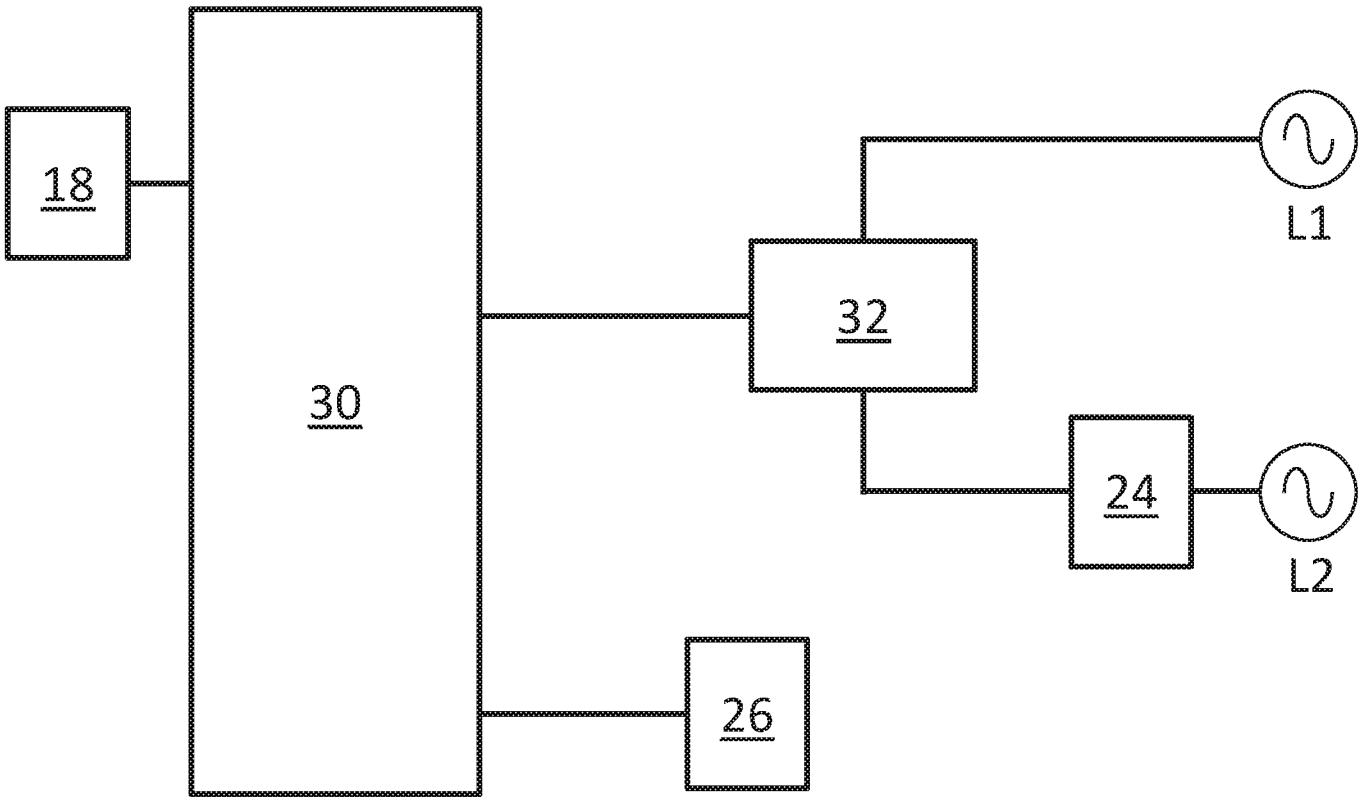
FIG. 4B provides another schematic diagram of a portion of the cooking appliance of FIG. 1.

Referring now to FIGS. 4A and 4B, schematic diagrams of a portion of cooking appliance 10 are provided. As stated, controller 30 may be in operative communication with various components of cooking appliance 10, e.g., heating sources 24 and user controls 18, such that, in response to user manipulation of user controls 18, controller 30 operates the various components of cooking appliance 10 to execute selected cycles and control various features of appliance 10. Controller 30 may also be in communication with temperature sensor 26 and an energy control device 32. Using the measurements provided by temperature sensor 26, controller 30 may control the power provided to heating source 24 to regulate or modulate the heat output of heating source assembly 22, e.g., to a heat output level or desired cooking temperature selected by the user by means of user control 18 or to keep the temperature of cooking utensil 12 below a predetermined maximum temperature. As an example, if heating source 24 is an electric heating source, controller 30 may be in operative communication with an energy control device 32 that interrupts the flow of current from a power source (not shown) to control the current provided to heating source 24 and thereby control the heat output of heating source 24. In such embodiments, device 32 may be an electromechanical device such as a relay or a solid-state device, e.g., a TRIAC (triode for alternating current) or the like. As another example, if heating source 24 is a gas heating source, controller 30 may be in operative communication with an energy control device 32 to control a flow of gas to heating source 24 and thereby control the heat output of heating source 24. In such embodiments, device 32 may be, e.g., an electronically controlled valve, a device for controlling a valve, or any other device that meters the flow of gas to heating source 24. Device 32 may, for example, reduce a size of a passageway for the flow of gas such that flames produced by heating source 24 are reduced, which in turn reduces the heat output of heating source 24. In other embodiments, device 32 may have other appropriate configurations for interrupting, reducing, or otherwise controlling the power provided to heating source 24 to control an amount of heat produced by heating source 24.

In some embodiments, as shown in FIG. 4A, user controls 18 may include or be in operative communication with a thermo-electro-mechanical switch, e.g., an infinite switch, or other mechanical device, e.g., a manual gas control valve, to control the heat output of heating source 24. For example, a user control such as a knob 18 may control a mechanical, electromechanical, or thermo-electro-mechanical device 31 (referred to generally herein as "mechanical device 31"), such as a bi-metal infinite switch. Mechanical device 31 may modulate the duty cycle of heating source 24, e.g., by opening or closing internal electrical contacts to regulate the duty cycle (i.e., the amount of time heating source 24 is on/off during a periodic switching cycle) based on the user input via control 18. In this embodiment, energy control device 32 may be used solely to substantially deactivate heating source 24 when controller 30 establishes that an unsafe situation exists, e.g., if the temperature of cooking utensil 12 sensed by temperature sensor 26 is exceeding or approaching a predefined temperature limit. In many instances, for example, when cooking a large water-based food item (such as boiling pasta in water), heating source 24 is controlled only by the mechanical device 31, and controller 30 never deactivates the heating source 24 using energy control device 32. As further described below, controller 30 may include temperature limiting software that deactivates heating source 24 using energy control device 32 only when temperature sensor 26 indicates an unsafe operating condition exists (or is soon to exist), as would generally be likely to occur when heating a skillet with a thin layer of cooking oil but not when heating a large water-based food item.

Because they are wired in series with the heat source 24, mechanical device 31 and energy control device 32 may each cause a pulse width modulation ("PWM") of the power provided to heating source 24 to regulate the heat output of the heating source. In general, heating source 24 is fully controlled via the mechanical device 31, which regulates the output heat level of heating source 24 according to a user's input via user control 18. As such, heating source 24 usually is controlled via energy control device 32 only in the case of an unsafe cooking condition; that is, when an unsafe condition is detected, PWM by the mechanical device 31 is overridden by the temperature limiting algorithm described below such that the energy control device 32 causes the PWM of power provided to heating source 24.

In other embodiments, as shown in FIG. 4B, user controls 18 may include or be in operative communication with a touch-sensitive control area 18 where the user may select a heat output level of a heating source 24 by touching the touch-sensitive control area. The touch-sensitive control area 18 is in communication with controller 30 to regulate or modulate the heat output level of heating source 24, e.g., by controlling the duty cycle of the heating source via energy control device 32 based on a typical control algorithm that relates the duty cycle to the user-selected heat output level. In this embodiment, energy control device 32 serves to control heating source 24 based on both the typical control algorithm and a safety control algorithm, or temperature limiting algorithm, further described below. Thus, energy control device 32 using a typical control algorithm, which relates the user setting to a heat output level, is the primary control of the heating source 24, rather than the mechanical device 31 described with respect to FIG. 4A. However, in the embodiment of FIG. 4B, controller 30 may include temperature limiting software that deactivates heating source 24 using energy control device 32 when temperature sensor 26 indicates an unsafe operating condition exists (or is soon to exist). That is, like the embodiment of FIG. 4A, controller 30 may include temperature limiting software that overrides the typical control algorithm to modulate the heat output level of heating source 24 according to a safety or temperature limiting control algorithm when an unsafe cooking condition is detected.

Accordingly, unlike embodiments having a mechanical device 31 as illustrated in FIG. 4A, embodiments of appliance 10 incorporating touch-sensitive or other electronic controls 18 utilize software to control heating sources 24 based on both the user-selected heating level and the preset temperature limiting feature. That is, in embodiments such as the embodiment of FIG. 4B, software replaces the behavior of mechanical device 31, and controller 30 produces a single signal to control energy control device 32 for both "normal" user-selected operation and "safety" temperature-limiting operation. For example, controller 30 may control device 32 to cycle heating source 24 between an "on" state and an "off" state during a given period, e.g., a relatively short time period such as 20 seconds, such that the average temperature or heat output over each cycle approximates the user-selected temperature or heat output level, respectively. That is, controller 30 may control the duty cycle of heating source 24 such that, based on the user's temperature or heat level selection via user control 18 and the temperature sensed by temperature sensor 26, controller 30 turns on heating source 24 for a fraction or portion of the duty cycle and turns off heating source 24 for the remainder of the duty cycle. In contrast, for cooking appliances 10 incorporating mechanical device 31, a user may, e.g., manipulate a user control 18 associated with a heating source 24 to select a desired heat output level for the heating source. The selection by the user controls what fraction or portion of the duty cycle heating source 24 should be on, e.g., if the user selects a midpoint heat output level, mechanical device 31 may control the duty cycle of heating source 24 such that heating source 24 is on for half of the duty cycle and off for half of the duty cycle. As another example, if the user selects the highest heat output level, mechanical device 31 may control the duty cycle such that heating source is in the on state over the entire period or cycle. In still other embodiments, the power provided to heating source 24 may be controlled in other ways. For example, where cooking appliance 10 utilizes gas burners as heating sources 24, a valve may be cycled between fully open, partially open, and substantially closed to modulate the power, i.e., gas, provided to gas heating source 24 and thereby control the heat output of heating source 24. In such embodiments, as valve is cycled such that a flow of gas therethrough is restricted, the valve may not be fully closed such that the gas burner does not require re-ignition during cycles of heating source 24.

As further described below, one or more methods may be used to limit a maximum temperature of cooking utensil 12 to prevent unsafe conditions of cooking appliance 10. In such methods, if cooking utensil 12 approaches a potentially unsafe temperature, controller 30 may be configured to utilize energy control device 32 to regulate or modulate the duty cycle of heating source 24 such that the average heat output over the duty cycle is a fraction of the user's selected heat output level.

FIG. 5 provides a chart illustrating a method for operating a cooking appliance, such as cooking appliance 10, according to an exemplary embodiment of the present subject matter. Although one or more portions of method 500 may be described below as performed by controller 30, it should be appreciated that method 500 may be performed in whole or in part by controller 30 or any other suitable device or devices.

At step 502, heating source 24 is activated at a user selected heat output level. For example, controller 30 may detect a touch input to a touch-type control 18 or the user may manipulate of a knob, button, or other mechanical control 18 to input a power or heat level for heating source 24. Typical heat output levels of cooking appliances range from "LOW," e.g., the lowest or least heat output of a heating source 24, to "HIGH," e.g., the highest or greatest heat output of heating source 24. Other heat output levels, e.g., medium-low ("MED-LOW"), medium ("MED"), medium-high ("MED-HI"), and the like between the lowest and the highest levels also may be selectable. Thus, at step 502, heating source 24 may be activated according to a user input (LOW, MED, HIGH, etc.), i.e., according to a heat output level selected by the user, such that power (e.g., electric current or gas) is provided to heating source 24 to enable heating source 24 to provide heat at the selected heat output level.

Power may be provided to heating source 24 according to one or more control modes, which, by modulating the power provided to the heating source, regulate the heat output of heating source 24 such that unwanted conditions are avoided yet cooking performance is not negatively affected. For example, as shown at step 504, power is initially provided to heating source 24 according to a first control mode M1. That is, for the particular heating source 24 activated at the user selected heat output level at step 502, power is provided to the heating source at a level $P_{HS}$ to produce a heat output based on the heat output level input, i.e., based on the user selected heat output. For example, as described above, controller 30 may control the duty cycle of heating source 24 to provide power at the power level $P_{HS}$ established by the first control mode M1. In another exemplary embodiment, the mechanical or thermo-electro-mechanical device 31 may control the duty cycle of heating source 24, as described above, to provide power at the power level $P_{HS}$ established by the first control mode M1. In still other embodiments, controller 30 may adjust a gas flow control valve to provide power at the power level $P_{HS}$ established by the first control mode M1.

A cooking utensil 12 may be positioned on heating source 24, and as heating source 24 outputs heat, the cooking utensil 12 and any food items therein begin to warm. In the first control mode M1, the power level $P_{HS}$ provided to heating source 24 is modulated as follows to help prevent cooking utensil 12 and/or any food items therein from overheating:

$$P_{HS}=(K_{p1}*T_{err})$$

where $$T_{err}=T_{limit}-T_{sensed}$$

In some embodiments, the power level $P_{HS}$ calculated using the above equation may specify a duty cycle for heating source 24. In other embodiments, the power $P_{HS}$ calculated using the above equation may specify the heat output of heating source 24 in other ways as well, e.g., by specifying the extent to which a valve is open to allow a flow of gas therethrough. In terms of the numerical calculation of $P_{HS}$, this parameter is a value between 0.0 and 1.0, where 0.0 corresponds to 0% power and 1.0 corresponds to 100% power; if the calculation produces a value outside of the 0.0 to 1.0 range, the value is truncated (i.e., limited) to 0.0 or 1.0, as appropriate. As shown above, the first control mode M1 may utilize a non-linear proportional (P) control algorithm. The non-linear proportional control algorithm employs an exponential proportional term; more particularly, the proportional term $K_{p1}*T_{err}$, is raised to a power of N, where N is greater than one (1). Further, the first control mode utilizes a temperature error $T_{err}$ to determine the power $P_{HS}$ provided to heating source 24. The temperature error $T_{err}$ is the difference between a target temperature limit $T_{limit}$ and a cooking utensil temperature $T_{sensed}$ measured or sensed by temperature sensor 26, which preferably is contact with or immediately adjacent bottom surface 11 of cooking utensil 12 as described above. In some embodiments, the measured or sensed temperature $T_{sensed}$ may be noise filtered to reduce the effects of spikes or irregularities in the measured values. Alternatively, the calculated $T_{err}$ and/or $P_{HS}$ terms rather than the $T_{sensed}$ term may be noise filtered. Any appropriate noise filter may be used, such as, e.g., a moving average filter, a lag filter, or the like.

The target temperature limit $T_{limit}$ is a predetermined temperature to which controller 30, using method 500, regulates the temperature of cooking utensil 12 to help prevent undesirable conditions that may occur as heat is provided to cooking utensil 12 and any food items within utensil 12. More specifically, as the temperature $T_{sensed}$ of cooking utensil 12 approaches the target temperature limit $T_{limit}$, the power provided to heating source 24 is "pinched off." That is, the value of N may be selected to quickly reduce the power provided to heating source 24 as the cooking utensil temperature $T_{sensed}$ approaches the target temperature limit $T_{limit}$. It will be appreciated that, if N is equal to one, the system is reduced to the traditional linear proportional control method, with heating source power linearly reduced as the utensil temperature approaches the target temperature. As such, it will be understood that the non-linear proportional control algorithm (i.e., with N greater than 1) may reduce the power provided to heating source 24 more quickly than traditional linear proportional controls. Also, the non-linear proportional control algorithm minimizes overshoot of the target temperature $T_{limit}$ compared to traditional linear proportional controls. As such, the non-linear control presents several advantages or benefits compared to the linear control.

Referring still to the above non-linear control, a first proportional gain factor or coefficient $K_{p1}$ may be used. The first proportional gain factor $K_{p1}$ may be determined based on the target temperature limit $T_{limit}$, and an enabling threshold temperature $T_{thr}$, i.e., a temperature above which it may be desirable to limit or substantially disable or reduce the power $P_{HS}$ provided to heating source 24. In some embodiments, the first proportional gain factor $K_{p1}$ may be determined as follows:

$$K_{p1} = \frac{100\%}{T_{limit} - T_{thr}}$$

The proportional coefficient $K_{p1}$ typically has units and scaling of (%/° C.)/100. As an example, if the control range over which heating source power is to be regulated to pinch off the power is 145° C. to 275° C., where the lower value is $T_{thr}$ and the upper value is $T_{limit}$, then the proportional coefficient $K_{p1}$ would be calculated as:

$$K_{p1} = \frac{100\%}{\frac{275^\circ\text{ C.} - 145^\circ\text{ C.}}{100}} = 0.77\frac{\%}{^\circ\text{ C.}} = 0.0077$$

Preferably, the first proportional gain factor $K_{p1}$ is calculated such that, in the first control mode M1, heating source 24 may be provided the full extent (i.e., 100%) of available power as long as the sensed temperature $T_{sensed}$ remains below the enabling threshold temperature $T_{thr}$, but the power $P_{HS}$ is dropped to zero or near zero when the sensed temperature $T_{sensed}$ exceeds the enabling threshold temperature $T_{thr}$ and approaches $T_{limit}$. That is, for cooking appliance 10 having electric heating sources 24, gain factor $K_{p1}$ is calculated such that heating sources 24 are be provided full power (i.e., the full extent of available current) by energy control device 32, as long as $T_{sensed}$ remains below $T_{thr}$. In embodiments in which cooking appliance 10 utilizes gas heating sources 24, gain factor $K_{p1}$ is calculated such that energy control device 32 e.g., the electronically-controlled gas flow valve controlling the flow of gas to the one or more burners 24, is fully open as long as $T_{sensed}$ remains below $T_{thr}$ to provide the full extent of available power to heating sources 24. Thus, the first proportional gain factor $K_{p1}$ may be predetermined and programmed into controller 30 for use in the first control mode M1.

Referring back to FIG. 5, at step 506, controller 30 determines if it should transition to a second control mode M2 and, if so, provides power to heating source 24 according to the second control mode M2, as shown at step 508. If controller 30 determines a transition to the second control mode M2 is not needed, controller 30 continues to provide power to heating source 24 according to the first control mode M1. As described in greater detail below with respect to method 600, controller 30 may determine to transition to the second control mode M2 if the temperature $T_{sensed}$ measured or sensed by temperature sensor 26 exceeds a predetermined temperature or if the power level $P_{HS}$ has been below a certain level for a predetermined period of time. Of course, other criteria may be used to determine whether the second control mode M2 should be utilized to provide power to heating source 24.

However, if controller 30 proceeds to step 508 and transitions to providing power to heating source 24 according to the second control mode M2, the power level $P_{HS}$ of heating source 24 is modulated as follows to help prevent cooking utensil 12 and/or any food items therein from overheating:

$$I = I + (K_i * T_{err})$$

$$P_{HS} = (K_{p2} * T_{err}) + I$$

In the second control mode M2, controller 30 may use energy control device 32 to control the power provided to heating source 24 and thereby control the heat output by heating source 24. As described above, in an exemplary embodiment, energy control device 32 may modulate the duty cycle of heating source 24 to control the power $P_{HS}$ provided to heating source 24 and thereby regulate the heat output by heating source 24. In other embodiments, energy control device 32 may modulate the extent to which a valve providing gas to heating source 24 is open to control the power $P_{HS}$ provided to heating source 24 and thereby regulate the heat output by heating source 24.

As shown, the second control mode M2 may utilize a proportional-integral (PI) control that uses the temperature error $T_{err}$, a second proportional gain factor $K_{p2}$, an integral gain factor $K_i$, and an integrated, incremented temperature error I to determine the power $P_{HS}$ provided to heating source 24. The second proportional gain factor $K_{p2}$ and integral gain factor $K_i$ may be predetermined and programmed into controller 30. For example, the second proportional gain factor $K_{p2}$ and the integral gain factor $K_i$ may be determined based on a specific system, e.g., based on a mass and power density of heating source 24 and/or a diameter, mass, and specific heat of cooking utensils 12 likely to be used with a particular cooking appliance 10. As such, the second proportional gain factor $K_{p2}$ and the integral gain factor $K_i$ used in the above PI control algorithm may vary from one embodiment to another of method 500. The integral term I may be established as a typical PI control integral term would be established. Alternatively, the second control mode may utilize a simple proportional control, where the integral term is omitted or zero. However, in either embodiment, the proportional terms $K_{p1}$ and $K_{p2}$ are not the same value (i.e., are not equal) and are derived to achieve different functionalities or behaviors for the different control modes. In general, $K_{p2}$ may be larger (i.e., more aggressive) than $K_{p1}$.

Method 500 may further include step 510, where controller 30 determines whether to transition back to the first control mode M1. If controller 30 determines to transition back to the first control mode M1, then method 500 returns to step 504 of providing power to heating source 24 according to the first control mode M1. If not, controller 30 continues to modulate the power $P_{HS}$ provided to heating source 24 according to the second control mode M2, as shown at step 508. As described more particularly with respect to method 600, controller 30 may compare the cooking utensil temperature $T_{sensed}$ measured or sensed by temperature sensor 26 to a disabling threshold temperature $T_{resume}$ to determine whether to return to using the first control mode M1 to modulate the power $P_{HS}$ provided to heating source 24. The disabling threshold temperature $T_{resume}$ may be a temperature below which "normal" operation of heating element 24 may resume, i.e., a temperature below which it is likely safe to resume providing power to the heating source according to the heat output level input by the user. Of course, in other embodiments, controller 30 may use other criteria to determine whether to transition back to the first control mode M1.

At any point after heating source 24 has been activated, the user may select to turn off the heating source, e.g., when a cooking operation is complete or for any other reason. Thus, controller 30 also may determine whether heating source 24 should be deactivated, i.e., if the user has selected to deactivate or turn off heating source 24. More particularly, controller 30 may determine heating source 24 should be deactivated based on an input by a user of cooking appliance 10, e.g., the user may manipulate a user control 18 that signals to controller 30 that heating source 24 should be deactivated. If controller 30 determines the user has selected to deactivate the heating source, controller 30 deactivates heating source 24. As stated, a user may select to deactivate heating source 24 at any point after the heating source is activated, such that controller 30 may determine at any point in method 500 after step 502 that heating source 24 should be deactivated. That is, method 500 may include a step of determining whether heating source 24 should be deactivated at or between any appropriate step or steps within the method and is not limited to providing the step of determining whether heating source 24 should be deactivated at any particular point(s) within method 500.

It will be appreciated that method 500 may be utilized with one or more heating sources 24 of cooking appliance 10. That is, controller 30 may control the heat output of one or more heating sources 24 of appliance 10 according to method 500. In some embodiments, the power $P_{HS}$ provided to every heating source 24 may be regulated according to method 500, but in other embodiments, only one or only a portion of the heating sources 24 of appliance 10 may be regulated using method 500. That is, not all of the heating sources 24 of appliance 10 may utilize the foregoing algorithm; some of the heating sources 24 might not have a temperature limiting system or might utilize an alternative temperature limiting system than as described with respect to method 500. However, where the temperature limiting system of method 500 is utilized, each heating source 24 preferably has its own unique temperature sensor 26 and a corresponding energy control device 32 modulated by a uniquely-calculated $P_{HS}$ value.

FIG. 6 provides a chart illustrating another method for operating a cooking appliance, such as cooking appliance 10, according to an exemplary embodiment of the present subject matter. Although one or more portions of method 600 may be described below as performed by controller 30, it should be appreciated that method 600 may be performed in whole or in part by controller 30 or any other suitable device or devices.

At step 602 of the illustrated embodiment, heating source 24 is activated at a user selected heat output level. For example, controller 30 may detect a touch input to a touch-type control 18 or the user may manipulate of a knob, button, or other mechanical control 18 to input a heat level for heating source 24. The heat output levels may range from "LOW," e.g., the lowest or least heat output of a heating source 24, to "HIGH," e.g., the highest or greatest heat output of heating source 24. Other heat output levels, e.g., medium-low ("MED-LOW"), medium ("MED"), medium-high ("MED-HI"), and the like between the lowest and the highest levels also may be selectable. Thus, at step 502, heating source 24 may be activated according to a user input (LOW, MED, HIGH, etc.), i.e., at a heat output level selected by the user. As such, power is provided to heating source 24 to enable heating source 24 to provide heat at the selected heat output level.

More particularly, as indicated at step 604, power is provided to heating source 24 according to the first control mode M1 described above. That is, for the particular heating source 24 activated at the user selected heat output level at step 602, power is provided to the heating source at a power level $P_{HS}$ to produce a heat output based on the heat output level that is input by the user, i.e., based on the user selected heat output level. For example, controller 30 may control the duty cycle of heating source 24, as described above, to provide power at the level $P_{HS}$ established by the first control mode M1. In another exemplary embodiment, the mechanical or thermo-electro-mechanical device 31 may control the duty cycle of heating source 24 to provide power at the power level $P_{HS}$ established by the first control mode M1. In still other embodiments, controller 30 may adjust a gas flow control valve to provide power at the power level $P_{HS}$ established by the first control mode M1.

At step 606*a*, controller 30 determines whether the power $P_{HS}$ provided is less than a minimum power level $P_{min}$, which may approximate an off, disabled, or substantially restricted condition of heating source 24. Stated differently, if the power provided to heating source 24 is less than the minimum power level $P_{min}$, the power provided to heating source 24 is such that heating source 24 essentially is disabled or provided a negligible level. In some embodiments, the minimum power level $P_{min}$ may be about 10% of the available power and, for example, the duty cycle of heating source 24 may be modulated such that the heating source is on for 10% of the duty cycle and off for the remaining 90% of its duty cycle. As another example, if the minimum power level $P_{min}$ is about 10% of the available power, a valve controlling a flow of gas to gas heating sources 24 may be open about 10% or less, such that the valve is substantially closed, when the power $P_{HS}$ provided is less than the minimum power level $P_{min}$. In other embodiments, the minimum power level $P_{min}$ may be about 5% or less. Other values of the minimum power level $P_{min}$ may be used as well.

If at step 606*a* the power level $P_{HS}$ is not less than the minimum power level $P_{min}$ (i.e., the power level $P_{HS}$ is greater than or equal to the minimum power level $P_{min}$), then method 600 proceeds to step 606*b*, where a timer is reset. The timer monitors a time interval $t_{off}$ that the power $P_{HS}$ provided to heating source 24 has been less than the minimum power level $P_{min}$. Therefore, if at step 606*a* the power level $P_{HS}$ is not less than the minimum power level $P_{min}$, the time interval $t_{off}$ is reset, i.e., set to zero, at step 606*b* because the power provided to heating source 24 has not been less than the minimum power level $P_{min}$ and, therefore, the utensil is still being significantly heated.

However, if controller 30 determines at step 606*a* that the power level $P_{HS}$ is less than the minimum power level $P_{min}$, method 600 proceeds to step 606*c*, where controller 30 increments the timer, which generally may be represented as $$t_{off}=t_{off}+1$$

such that the current value of $t_{off}$ is incrementally increased at a fixed rate over the previous value of time interval $t_{off}$. Of course, in other embodiments, the time interval $t_{off}$ may be incremented in a non-linear or at a non-fixed rate. In any event, the timer is incremented whenever the power level $P_{HS}$ is less than the minimum power level $P_{min}$, i.e., whenever significant heating of the utensil has ceased and the heating source is essentially off.

After the timer is incremented, controller 30 determines at step 606*d* whether the timer has surpassed a threshold time interval $t_{thr}$. The threshold time interval $t_{thr}$ is a predetermined time period that may be, e.g., the maximum amount of time the power level $P_{HS}$ needs to be below the minimum power level $P_{min}$ to avoid extreme temperatures of cooking utensil 12 and/or food items therein that could lead to undesirable events such as fires, smoke, or the like. That is, by reducing the power level $P_{HS}$ below the minimum power level $P_{min}$ for at least a time interval $t_{thr}$, the temperature of cooking utensil 12 may be prevented from rising above a maximum temperature. In other words, controller 30 may reduce the power level $P_{HS}$ to control the temperature of utensil 12 to a maximum temperature, such as the target temperature limit $T_{limit}$. If the time interval $t_{off}$ is greater than the threshold time interval $t_{thr}$, method 600 proceeds to step 608 in order to control heating source 24 according to the second control mode M2, as further described below.

Referring to FIG. 6, from step 606*b* where the timer is reset, or if at step 606*d* the time interval $t_{off}$ has not surpassed the threshold time interval $t_{thr}$, method 600 proceeds to step 606*e*. At step 606*e*, controller 30 determines whether the cooking utensil temperature $T_{sensed}$ is at least equal to the target temperature limit $T_{limit}$. If not, controller 30 continues to provide power to heating source 24 according to the first control mode M1, as shown in FIG. 6. But if the temperature $T_{sensed}$ of cooking utensil 12 is at least equal to the target temperature limit $T_{limit}$, then method 600 proceeds to step 608. At step 608, controller 30 provides power $P_{HS}$ to heating source 24 according to the second control mode M2, which may include varying the duty cycle of heating source 24 to provide the power level $P_{HS}$ established by the PI control described above. Thus, steps 606*d* and 606*e* ensure that method 600 proceeds to step 608 and the second control mode M2 is entered into by whichever criteria occurs first, i.e., if heating source 24 has been essentially off a maximum amount of time or if the utensil temperature has exceeded the target temperature limit, controller 30 proceeds to regulate heating source 24 according to the second control mode M2. Further, by limiting the time that heating source 24 is essentially off, the control system never gets "stuck" in an essentially off state, even if the cooking utensil temperature $T_{sensed}$ fails to rise above the target temperature limit.

As illustrated at step 610, controller 30 next determines whether to transition back to the first control mode M1. Controller 30 may determine whether to transition back to the first control mode M1 by comparing the cooking utensil temperature $T_{sensed}$ to a disabling threshold temperature $T_{resume}$. If the temperature $T_{sensed}$ of cooking utensil 12 is at or below the disabling threshold temperature $T_{resume}$, controller 30 may determine to transition back to providing power to heating source 24 according to the first control mode M1. If so, then method 600 returns to step 604 and the power level $P_{HS}$ of heating source 24 is established using the non-linear proportional control algorithm previously described. However, if controller 30 determines not to transition back to the first control mode M1, controller 30 continues to modulate the power $P_{HS}$ provided to heating source 24 according to the second control mode M2, as shown in FIG. 6.

At any point after heating source 24 has been activated, the user may select to turn off the heating source, e.g., when a cooking operation is complete or for any other reason. Thus, controller 30 also may determine whether heating source 24 should be deactivated, i.e., if the user has selected to deactivate or turn off heating source 24. More particularly, controller 30 may determine heating source 24 should be deactivated based on an input by a user of cooking appliance 10, e.g., the user may manipulate a user control 18 that signals to controller 30 that heating source 24 should be deactivated. If controller 30 determines the user has selected to deactivate the heating source, controller 30 deactivates heating source 24. As stated, a user may select to deactivate heating source 24 at any point after the heating source is activated, such that controller 30 may determine at any point in method 600 after step 602 that heating source 24 should be deactivated. That is, method 600 may include a step of determining whether heating source 24 should be deactivated at or between any appropriate step or steps within the method and is not limited to providing the step of determining whether heating source 24 should be deactivated at any particular point(s) within method 600.

It will be readily understood that method 600 may be utilized with one or more heating sources 24 of cooking appliance 10. That is, controller 30 may control the heat output of one or more heating sources 24 of appliance 10 according to method 600. In some embodiments, the power $P_{HS}$ provided to every heating source 24 may be regulated according to method 600, but in other embodiments, only one or only a portion of the heating sources 24 of appliance 10 may be regulated using method 600. That is, not all of the heating sources 24 of appliance 10 may utilize the foregoing algorithm; some of the heating sources 24 might not have a temperature limiting system or might utilize an alternative temperature limiting system than as described with respect to method 600. However, where the temperature limiting system of method 600 is utilized, each heating source 24 preferably has its own unique temperature sensor 26 and a corresponding energy control device 32 modulated by a uniquely-calculated $P_{HS}$ value.

It should be appreciated by those experienced in the art that the calculations of methods 500 and 600 are performed in a repetitive manner (i.e., the calculations are looping) at a fixed and predetermined rate. The rate at which this looping occurs can be determined in a variety of ways, but in general, the rate should be faster than the thermal step response of the combined heating source 24 and cooking utensil 12. In an exemplary embodiment, the loop rate may be one second, as a loop rate of one second tends to provide adequate performance for an electric coil cooking system. However, other loop rates may be used as well.

Figure 7:
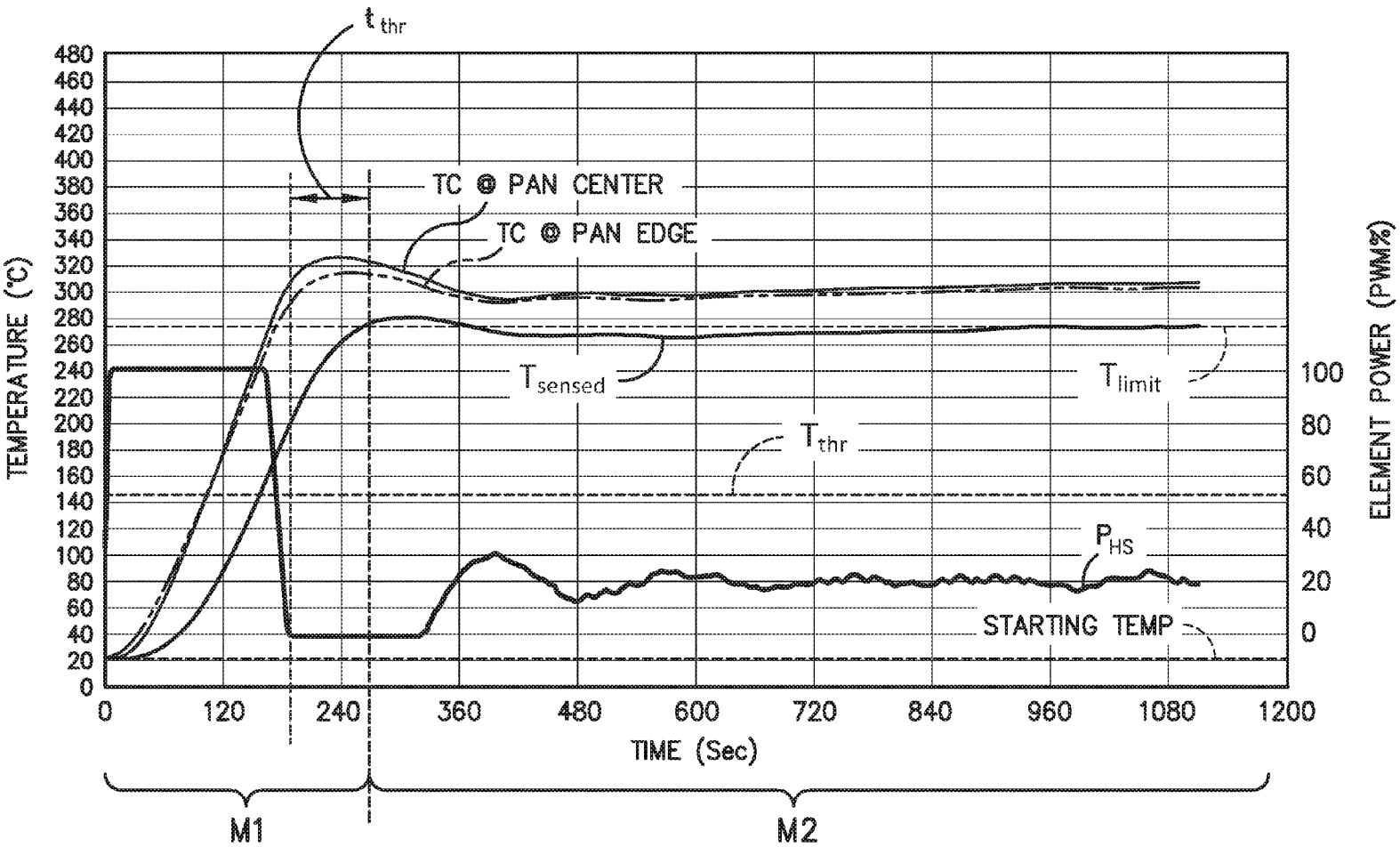
FIG. 7 provides a graph of cooking utensil temperature and heating source power over time for a lightly-loaded cooking utensil, according to an exemplary embodiment of the present subject matter.
Figure 8:
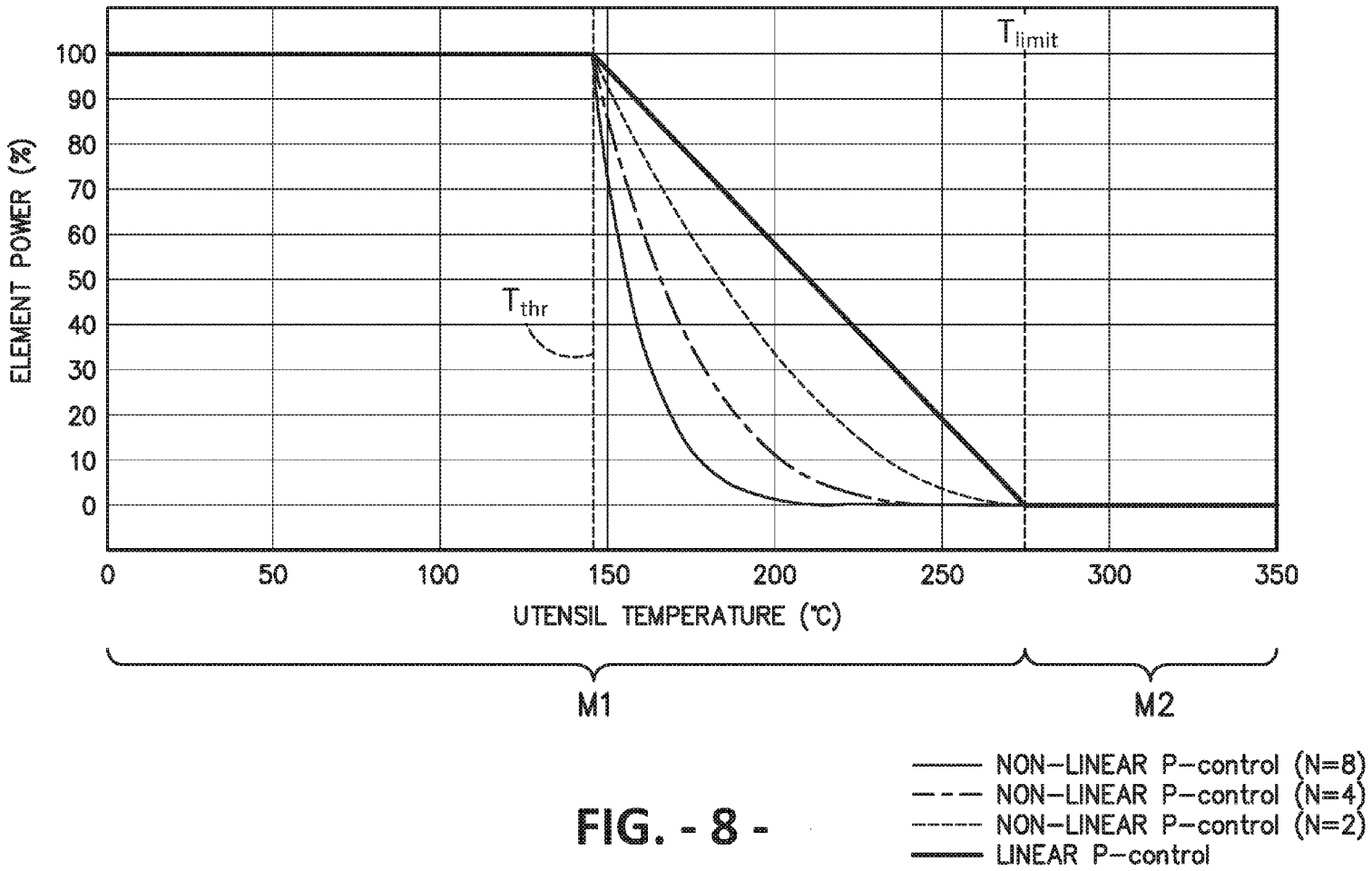
FIG. 8 provides a graph illustrating the difference between a traditional linear proportional control and the non-linear proportional control scheme of the present subject matter.

FIG. 7 provides a graph illustrating how a temperature of a cooking utensil 12 may be regulated using method 500 or method 600. In the depicted embodiment of FIG. 7, the enabling threshold temperature $T_{thr}$ is approximately 145° C., a temperature slightly above the temperature which typically is reported by sensor 26 when water is being boiled (sensor 26 typically reports 125° C. to 135° C. to controller 30 as the sensed temperature of boiling water due to, e.g., stray infrared energy from the heating source and drip try impinging on the sensor); the target temperature limit $T_{limit}$ is approximately 275° C., a temperature below the upper range of temperature sensor 26 and within the upper range of typical cooking conditions but well below an oil self-ignition temperature of about 400° C.; and the disabling threshold temperature $T_{resume}$ is approximately 120° C., a temperature at which the control system will resume allowing heating source 24 to operate at full power as there is little likelihood of producing an unsafe condition of cooking appliance 10. The minimum power level $P_{min}$ is about one percent (1%), e.g., heating source 24 is on for 1% of its duty cycle and off for 99% of its duty cycle or a gas flow control valve is 1% open, where the minimum power level $P_{min}$ represents a power level below which heating source 24 is considered to be off. Further, the threshold time $t_{thr}$ is approximately 120 seconds and the value of N is 8; the effect of the value of the exponential coefficient N is depicted in FIG. 8. Of course, other values of the enabling threshold temperature $T_{thr}$, target temperature limit $T_{limit}$, disabling threshold temperature $T_{resume}$, minimum power level $P_{min}$, threshold time $t_{thr}$, and the exponential N also may be used.

As illustrated in FIG. 7, in the period M1, controller 30 modulates the power $P_{HS}$ provided to heating source 24 according to the first control mode M1. The sharp decline in the power level $P_{HS}$ from approximately 100% to approximately 0% illustrates how the non-linear control algorithm causes the power to "pinch off" when the temperature $T_{sensed}$ of cooking utensil 12 exceeds the enabling threshold temperature $T_{thr}$, which is 145° C. in this depicted embodiment. As further shown in FIG. 7, when the cooking utensil temperature $T_{sensed}$ reaches the target temperature limit $T_{limit}$ (275° C. in this example embodiment), controller 30 transitions from the first control mode M1 to the second control mode M2. The period M2 illustrates controller 30 modulating the power $P_{HS}$ provided to heating source 24 according to the PI control algorithm described above. As shown, by varying the power level $P_{HS}$ of heating source 24 according to the PI control algorithm, the cooking utensil temperature $T_{sensed}$ can be regulated about the target temperature limit $T_{limit}$.

As shown in FIG. 7, the temperature of cooking utensil 12 can be limited to a maximum temperature such as the target temperature limit $T_{limit}$. By limiting the temperature of a cooking utensil 12 positioned on a heating source of the cooking appliance, the temperature of any food items within the cooking utensil also may be limited, which can help prevent unsafe or undesirable conditions such as fire, smoke, and the like. More particularly, regulating the cooking utensil temperature to remain at or below a predetermined maximum temperature may help eliminate or avoid cooking fires commonly associated with grease or cooking oils, which can ignite due to excessive utensil temperatures.

Referring now to FIG. 8, a graph is provided illustrating the effect of various values of the exponential N used in the first control mode. As illustrated, the power provided to heating source 24 is pinched off more quickly as increasing values of N are used. For example, the power is pinched off faster when N is 8 than when N is 2 or when a linear proportional algorithm is used. As such, the value of N may be selected such that controller 30 appropriately responds to the temperatures sensed by temperature sensor 26, pinching-off the power delivered to the heating source 24 abruptly as the temperature of utensil 12 continues to rise toward the target temperature limit, i.e., the temperature to which the utensil is limited. Selection of the proper exponential N will depend upon the physical details of the heating source, for instance, electric or gas heating source, exposed heating source or hidden heating source (e.g., under a substrate), etc.

Figure 9:
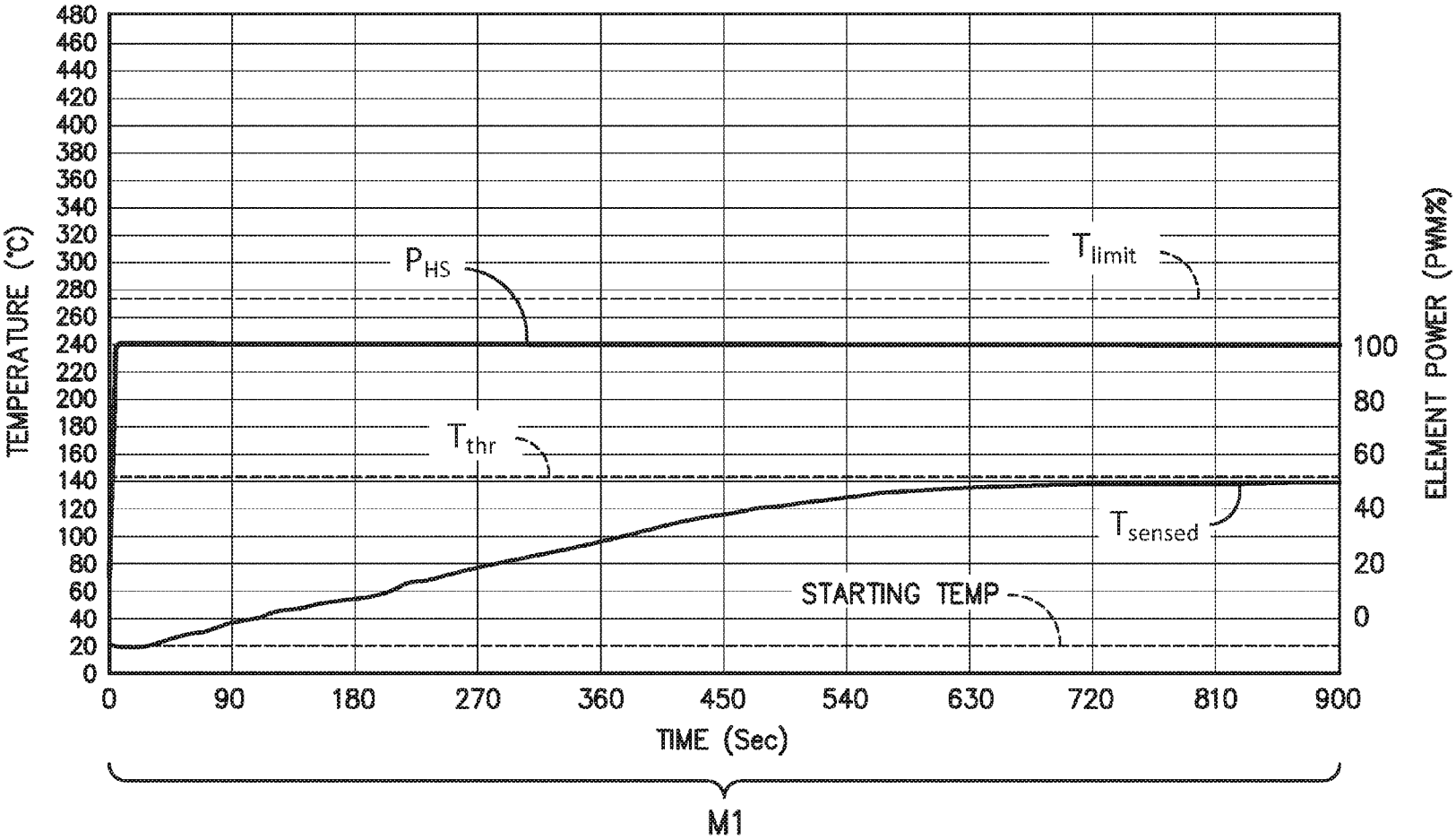
FIG. 9 provides a graph of cooking utensil temperature and heating source power over time for a heavily-loaded cooking utensil, according to an exemplary embodiment of the present subject matter.

FIG. 9 provides a graph illustrating another exemplary embodiment of method 500 or method 600. In the depicted embodiment, the various parameters have the same values as given with respect to the embodiment illustrated in FIG. 7. However, whereas FIG. 7 depicts the heating of a lightly loaded cooking utensil 12 (e.g., a skillet with a thin layer of cooking oil therein), FIG. 9 depicts the heating of a heavily loaded cooking utensil 12 (e.g., a large pot of water). As shown in FIG. 9, cooking utensil 12 and any food items therein heat up more slowly than as depicted in FIG. 7. Further, the cooking utensil temperature $T_{sensed}$ remains below the threshold temperature $T_{thr}$. Accordingly, throughout time period illustrated in FIG. 9, controller 30 provides power to heating source 24 according to the first control mode M1 and does not transition to the second control mode M2. In other words, full power is continuously applied to heating source 24 for the duration of the cooking period; thus, FIG. 9 illustrates that the cooktop performance in this situation is not degraded by the addition of the temperature limiting algorithm.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A cooking appliance, comprising:

a heating source;

a temperature sensor, the temperature sensor positioned to sense the temperature $T_{sensed}$ of a bottom surface of a cooking utensil when the cooking utensil is placed on or adjacent to the heating source;

an energy control device for modulating the power provided to the heating source;

a controller having a memory and a processor for executing programming instructions, the controller in operative communication with the temperature sensor and the energy control device, the controller programmed for providing power to the heating source according to a first control mode, comparing the temperature $T_{sensed}$ sensed by the temperature sensor to a target temperature limit $T_{limit}$ to determine if the temperature $T_{sensed}$ of the cooking utensil is greater than the target temperature limit $T_{limit}$ and, if so, then transitioning to a second control mode such that power is provided to the heating source according to the second control mode, comparing the temperature $T_{sensed}$ sensed by the temperature sensor to a threshold temperature $T_{resume}$ to determine if the temperature $T_{sensed}$ of the cooking utensil is less than the threshold temperature $T_{resume}$ and, if so, then returning to providing power to the heating source according to the first control mode, wherein power is provided to the heating source in the first control mode using a non-linear proportional control algorithm having an exponential proportional term, and wherein power is provided to the heating source in the second control mode using a linear proportional or proportional-integral control algorithm.

2. The cooking appliance of claim 1, wherein the temperature sensor is a spring-loaded temperature sensor.

3. The cooking appliance of claim 1, wherein the temperature sensor is positioned to contact the bottom surface of the cooking utensil.

4. The cooking appliance of claim 1, wherein the non-linear proportional control algorithm is the product of a first proportional gain factor $K_{p1}$ and a temperature error $T_{err}$ raised to a power of N, and wherein N is greater than one.

5. The cooking appliance of claim 4, wherein the temperature error $T_{err}$ is the difference between the target temperature limit $T_{limit}$ and the temperature $T_{sensed}$ sensed by the temperature sensor, and wherein the target temperature limit $T_{limit}$ is a predetermined maximum temperature of the cooking utensil.

6. The cooking appliance of claim 4, wherein N is eight (8) such that the product of the first proportional gain factor $K_{p1}$ and the temperature error $T_{err}$ is raised to the eighth power.

7. The cooking appliance of claim 1, wherein power is provided to the heating source in the second control mode using a linear proportional-integral control algorithm wherein the power provided to the heating source equals the sum of an integral term I and the product of a second proportional gain factor $K_{p2}$ and a temperature error $T_{err}$.

8. The cooking appliance of claim 1, wherein if the temperature $T_{sensed}$ of the cooking utensil is not greater than the target temperature limit $T_{limit}$, the controller continues to provide power to the heating source according to the first control mode.

9. The cooking appliance of claim 1, wherein if the temperature $T_{sensed}$ of the cooking utensil is less than the threshold temperature $T_{resume}$, the controller continues to provide power to the heating source according to the second control mode.

10. A cooking appliance, comprising:

a heating source;

a temperature sensor, the temperature sensor positioned to sense the temperature $T_{sensed}$ of a bottom surface of a cooking utensil when the cooking utensil is placed on or adjacent to the heating source;

an energy control device for modulating the power provided to the heating source;

a controller, the controller in operative communication with the temperature sensor and the energy control device, the controller configured for providing power to the heating source according to a first control mode, comparing the temperature $T_{sensed}$ sensed by the temperature sensor to a target temperature limit $T_{limit}$ to determine if the temperature $T_{sensed}$ of the cooking utensil is greater than the target temperature limit $T_{limit}$ and, if so, then providing power to the heating source according to the second control mode, comparing the temperature $T_{sensed}$ sensed by the temperature sensor to a threshold temperature $T_{resume}$ to determine if the temperature $T_{sensed}$ of the cooking utensil is less than the threshold temperature $T_{resume}$ and, if so, then returning to providing power to the heating source according to the first control mode, wherein power is provided to the heating source in the first control mode using a non-linear proportional control algorithm wherein the power provided to the heating source equals the product of a first proportional gain factor $K_{p1}$ and a temperature error $T_{err}$ and the product is raised to a power of N, wherein power is provided to the heating source in the second control mode using a linear proportional-integral control algorithm wherein the power provided to the heating source equals the sum of an integral term I and the product of a second proportional gain factor $K_{p2}$ and the temperature error $T_{err}$.

11. The cooking appliance of claim 10, wherein the power of N is eight (8) such that the product of the first proportional gain factor $K_{p1}$ and the temperature error $T_{err}$ is raised to the eighth power.

12. The cooking appliance of claim 10, wherein the temperature error $T_{err}$ is the difference between the target temperature limit $T_{limit}$ and the temperature $T_{sensed}$ sensed by the temperature sensor, and wherein the target temperature limit $T_{limit}$ is a predetermined maximum temperature of the cooking utensil.

* * * * *